United States Patent [19]

Nishi et al.

[11] Patent Number: 4,804,948

[45] Date of Patent: Feb. 14, 1989

[54] VIDEO DISPLAY CONTROL SYSTEM

[75] Inventors: Kazuhiko Nishi; Takatoshi Ishii; Ryozo Yamashita, all of Tokyo; Shigemitsu Yamaoka; Takatoshi Okumura, both of Hamamatsu, all of Japan

[73] Assignees: ASCII Corp., Tokyo; Nippon Gakki Seizo Kabushiki Kaisha, Hamamatsu, both of Japan

[21] Appl. No.: 77,984

[22] Filed: Jul. 27, 1987

Related U.S. Application Data

[63] Continuation of Ser. No. 734,165, May 15, 1985, abandoned.

[30] Foreign Application Priority Data

May 18, 1984 [JP] Japan ..... 59-100303

[51] Int. Cl.[4] ..... G09G 1/16

[52] U.S. Cl. ..... 340/703; 340/747; 340/721

[58] Field of Search ..... 340/747, 721, 723, 703, 340/701

[56] References Cited

U.S. PATENT DOCUMENTS

| | | | |
|---|---|---|---|
| 3,911,418 | 10/1975 | Takeda | 340/703 |
| 4,075,700 | 2/1978 | Blay | 340/703 |
| 4,439,759 | 3/1984 | Fleming et al. | 340/703 |
| 4,534,059 | 8/1985 | Yamada | 358/284 |
| 4,564,859 | 1/1986 | Knop et al. | 358/75 |
| 4,570,233 | 2/1986 | Yan | 340/747 |

FOREIGN PATENT DOCUMENTS

| | | | |
|---|---|---|---|
| 57-143683 | 9/1982 | Japan | 358/75 |
| 58-142676 | 8/1983 | Japan | 358/75 |

*Primary Examiner*—Marshall M. Curtis

*Attorney, Agent, or Firm*—Cushman, Darby & Cushman

[57] ABSTRACT

A video display control system displays a video image composed of a plurality of display elements on a screen of a video display unit. The system comprises a memory (VRAM) for storing a plurality of color codes each representing at least one display element and a video display controller (VDP). The VDP comprises a mode register for selecting one of normal display and transparency processing modes, display processing circuit for reading the color codes from the VRAM, a backdrop color register for storing a color code such as one representing a backdrop color, a detection circuit for detecting a predetermined color code from the color codes read by the display processing circuit, and a selector controlled by an output of the detection circuit. In the normal display mode, the selector outputs all color codes read by the display processing circuit to the display unit. In the transparency processing mode, the selector outputs the color codes read by the display processing circuit to the display unit when the predetermined color code is not detected, and outputs the color code contained in the backdrop color register to the display unit when the predetermined color code is detected. The VDP further comprises another detection circuit for detecting a second predetermined color code from the color codes outputted from the selector to output a control signal. And if the second predetermined color code is detected in the transparency processing mode, the display unit displays an image in accordance with an external video signal.

12 Claims, 2 Drawing Sheets

VIDEO DISPLAY CONTROL SYSTEM

This is a continuation of application Ser. No. 734,165 filed May 15, 1985 which was abandoned upon the filing hereof.

BACKGROUND OF THE INVENTION

1. Field of the Invention

This invention relates to a video display control system for use as terminal equipment for a computer or video machines.

2. Prior Art

There has recently been proposed a video display control system which comprises a video display controller, a central processing unit (CPU), a video RAM (VRAM) and a CRT display unit and displays a color video image composed of a plurality of display elements on a screen of the CRT display unit in accordance with color codes read by the video display controller from the VRAM. There has been known among such systems, one in which each color code is composed of, for example, four bits for selecting one of sixteen colors, and wherein one of the sixteen color codes (for example one represented by "0, 0, 0, 0") is assigned to transparency. In such system, when a color code representative of transparency is read from the RAM, a display element on the screen corresponding to the read color code is displayed in a predetermined backdrop color or in a color of the corresponding display element of the backdrop image.

The color code representative of transparency is particularly useful to superimpose a video image over another video image but is rarely used in display processing other than the superimpose processing. It is therefore desirable to use the color code representative of transparency as a color code representative of an additional color in the case where the superimpose processing is not carried out. However, with the conventional system in which each color code is composed of, for example, four bits, a specific one of the sixteen color codes is used as the color code representative of transparency as described above, so that only fifteen colors can be designated by the color codes.

SUMMARY OF THE INVENTION

It is therefore an object of the present invention to provide a video display control system in which one of color codes can be used either as a color code representative of transparency or as a color code representative of a specific color.

According to one aspect of the present invention, there is provided a video display control system adapted to be connected to a video display unit for displaying a video image composed of a plurality of display elements on a screen of the video display unit comprising: (a) memory means for storing a plurality of color codes each representing at least one of the display elements; and (b) display control means having (i) designating means for designating one of first to Nth display modes ($N \geqq 2$); (ii) reading means for reading each of the color codes from the memory means; (iii) first determination means for determining whether each color code read from the memory means coincides with a first predetermined color code to output a first coincidence signal; and (iv) conversion means for converting the color code read from the memory means into a certain color code in response to the first coincidence signal when the designating means designates the first display mode, the certain color code being supplied to the video display unit. The display control means may further comprise code register means for storing the certain color code. Also, the display control means may further comprise second determination means for determining whether the color code outputted from the selector means coincides with a second predetermined color code to output a second coincidence signal, and means for feeding an external video signal to the video display unit in response to the second coincidence signal when the designating means designates the first display mode.

According to another aspect of the present invention, there is provided a video display control system adapted to be connected to a video display unit for displaying a video image composed of a plurality of display elements on a screen of the video display unit comprising: (a) memory means for storing a plurality of color codes each representing at least one of the display elements; and (b) display control means having (i) designating means for designating one of first to Nth display modes ($N \geqq 2$); (ii) reading means for reading the color codes from the memory means; (iii) determination means for determining whether each color code read from the memory means coincides with a predetermined color code to output a determination result; and (iv) feeding means for feeding an external video signal to the video display unit in accordance with the designated display mode and the determination result.

DESCRIPTION OF THE PREFERRED EMBODIMENT OF THE INVENTION

Figure 1:
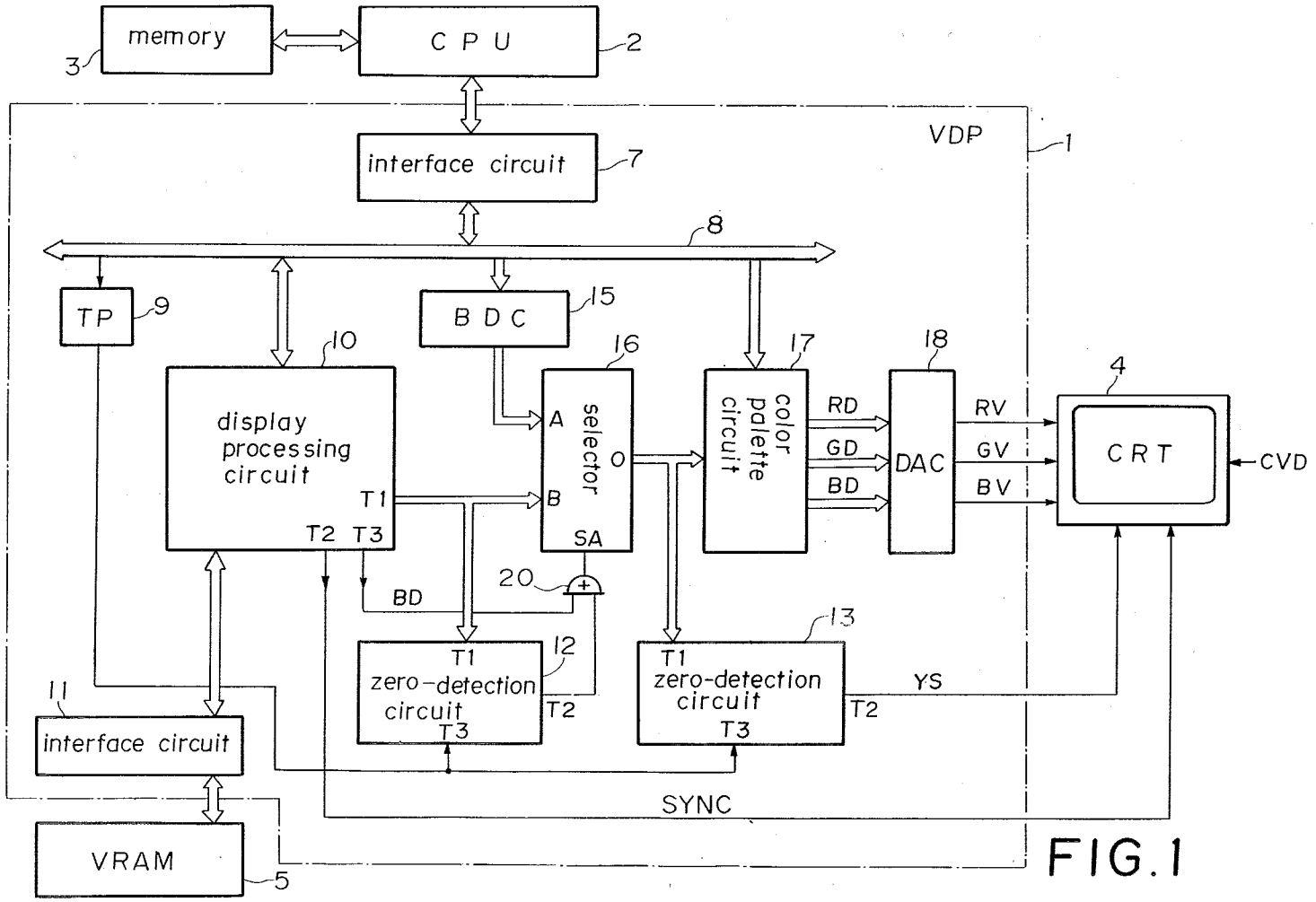
FIG. 1 is a block diagram of a video display control system provided in accordance with the present invention.

FIG. 1 shows a video display control system which comprises a video display controller (hereinafter referred to as "VDP") 1, a central processing unit (CPU) 2, a memory 3, a raster-scanned CRT display unit 4 and a video RAM (VRAM) 5. The memory 3 comprises a read only memory (ROM) for storing programs to be executed by the CPU 2 and a RAM for storing data to be processed by the CPU 2. A screen of the CRT display unit 4 provides a plurality of display elements which constitute a display image, and the VRAM 5 stores in a dot-map fashion a plurality of color codes each comprised of four bits and corresponding to a respective one of the display elements on the screen. Upon receipt of a display command from the CPU 2, the VDP 1 sequentially reads the color codes from the VRAM 5 and converts each of the read color codes into analog color signals RV (red), GV (green) and BV (blue) signals. The analog color signals RV, GV and BV are supplied to the CRT display unit 4 in synchronization with the scanning of the screen thereof, thereby a color video image represented by the read color codes being displayed on the screen. Incidentally, before outputting the display command, the CPU 2 writes the color codes into the VRAM 5 through the VDP 1.

As described above, each color code used in this system is composed of four bits so that a video image can be displayed on the screen in sixteen kinds of colors.

Also, a color code of "0, 0, 0, 0" is assigned to transparency. More specifically, the color code of "0, 0, 0, 0" can represent either transparency or a specific color, and the CPU 2 determines whether the color code represents transparency or the specific color.

Figure 2:
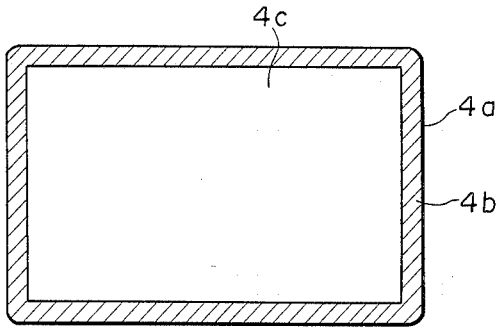
FIG. 2 is an illustration showing a screen of a CRT display unit of the system of FIG. 1.

The VDP 1 will now be more fully described. The VDP 1 comprises an interface circuit 7 connected to the CPU 2 and an internal bus 8 connected to the interface circuit 7. A TP register 9 is a one-bit register into which a bit data of "1" or "0" is written by the CPU 2 via the interface circuit 7. This TP register 9 is used to determine whether the color code of "0, 0, 0, 0" represents transparency or the specific color. The CPU 2 writes "0" into the TP register 9 when the color code of "0, 0, 0, 0" is to be used as a color code representative of transparency, and writes "1" when the color code of "0, 0, 0, 0" is to be used as a color code representative of the specific color. This TP register 9 is comprised of a flip-flop such as a D-type flip-flop and a J-K flip-flop and is supplied with a write signal WE (not shown in FIG. 1) from the CPU 2 via the interface circuit 7. An image data processing circuit 10, before beginning its display operation, supplies color codes outputted from the CPU 2 to the VRAM 5 via the interface circuit 11 and writes the color codes into designated memory area of the VRAM 5. Upon receipt of a display command, the image data processing circuit 10 sequentially reads the color codes from the VRAM 5 and outputs the read color codes from an output terminal T1 thereof in synchronization with the scanning of the screen of the CRT display unit 4. This image data processing circuit 10 also outputs a synchronization signal SYNC from an output terminal T2 thereof to the CRT display unit 4 and outputs a border signal BD from an output terminal T3 thereof. As shown in FIG. 2, there is provided on a peripheral marginal portion of the screen 4*a* of the CRT display unit 4 a non-display area 4*b*. And the border signal BD of "1" is outputted during the period when the non-display area 4*b* is being scanned. A zero-detection circuit 12 determines whether a color code applied to an input terminal T1 thereof is "0, 0, 0, 0", and outputs a "1" signal from an output terminal T2 thereof when the color code applied to the input terminal T1 is "0, 0, 0, 0". A zero-detection circuit 13 is of the same construction as that of the zero-detection circuit 12. Each of the zero-detection circuits 12 and 13 is enabled to operate when a "0" signal is applied to a terminal T3 thereof, i.e., when the TP register 9 stores "0", and is disabled when a "1" signal is applied to the terminal T3 thereof. When disabled, both of the zero-detection circuits 12 and 13 output "0" signals from the output terminals T2 thereof. Each of the zero-detection circuits 12 and 13 may comprise four inverters for inverting respective bit signals of a color code applied thereto and an AND gate with five input terminals to which output signals of the four inverters and TP register 9 are supplied.

A backdrop color register (hereinafter referred to as "BDC register") 15 is a four-bit register for storing a color code supplied from the CPU 2. A selector 16 outputs from an output terminal 0 thereof a color code supplied to an input terminal A when a "1" signal is applied to a selection terminal $\overline{SA}$, and outputs from the output terminal 0 a color code supplied to an input terminal B when a "0" signal is applied to the selection terminal $\overline{SA}$. A color palette circuit 17 is a code converter and converts a color code supplied from the selector 16 into three color data RD (red data), GD (green data) and BD (blue data) each composed of three bits. More specifically, this color palette circuit 17 comprises sixteen registers #0 to #15 each composed of nine bits, and outputs the contents of the register #0 when a color code of "0, 0, 0, 0" is supplied, the contents of the register #1 when a color code of "0, 0, 0, 1" is supplied, . . . and the contents of the register #15 when a color code of "1, 1, 1, 1" is supplied. The writing of data into these registers #0 to #15 is effected by the CPU 2. A digital-to-analog converter (DAC) 18 converts the color data RD, GD and BD into the analog color signals RV (red), GV (green) and BV (blue), respectively, and supplies these analog color signals RV, GV and BV to the CRT display unit 4. This CRT display unit 4 is a normal TV set, but is constructed so as to effect a display operation in accordance with the analog color signals RV, GV and BV and synchronization signal SYNC when a signal YS of "0" is supplied from the output terminal T2 of the zero-detection circuit 13. The CRT display unit 4 is also so constructed as to effect a display operation irrespective of the analog color signals RV, GV and BV and synchronization signal SYNC but in accordance with another video signal CVD outputted from another device when the signal YS is "1".

With this arrangement, when the output of the TP register 9 is "1", both of the zero-detection circuits 12 and 13 are disabled and output "0" signals. In this case, an OR gate 20 outputs a "1" signal only when the display processing circuit 10 outputs the signal BD of "1". And therefore, when the display processing circuit 10 outputs the signal BD of "1", a color code contained in the BDC register 15 is supplied to the color palette circuit 17 through the selector 16. On the other hand, when the signal BD is "0", i.e., when the display area 4*c* surrounded by the border area 4*b* on the screen (FIG. 2) is being scanned, the OR gate 20 outputs a "0" signal so that a color code outputed from the output terminal T1 of the display processing circuit 10 is supplied to the color palette circuit 17 through the selector 16. The color palette circuit 17 outputs color data RD, GD and BD in accordance with the supplied color code, and the DAC 18 produces analog color signals RV, GV and BV in accordance with the color data and supplies these analog color signals to the CRT display unit 4. Thus, when the output of the TP register 9 is "1", display elements in the border area 4*b* on the screen (FIG. 2) are displayed in a color (backdrop color) designated by the color code contained in the BDC register 15, while display elements in the display area 4*c* are displayed in accordance with color codes read from the VRAM 5. And in this case, when a color code of "0, 0, 0, 0" is applied to the color palette circuit 17, the contents of the register #0 of the color palette circuit 17 are outputted to the DAC 18 so that the corresponding display element is displayed in a color designated by the contents of the register #0. In other words, the color code of "0, 0, 0, 0" is processed not as a color code representative of transparency but as a color code representative of a specific color.

Figure 3:
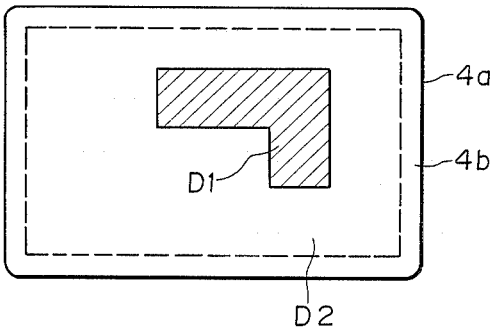
FIG. 3 is an illustration showing the screen on which one example of a video image is displayed.

In the case where the TP register 9 outputs a signal of "0", both of the zero-detection circuits 12 and 13 are enabled so that a color code of "0, 0, 0, 0" is processed as a color code representative of transparency. More specifically, when a color code other than "0, 0, 0, 0" is outputted from the display processing circuit 10 with the border signal of "0", the output of the OR gate 20 is rendered "0" so that the color code outputted from the output terminal T1 of the display processing circuit 10 is supplied to the color palette circuit 17 through the selector 16. As a result, the corresponding display element on the screen, which is located in the display area 4c in this case, is displayed in a color designated by the color code outputted from the display processing circuit 10. On the other hand, when the display processing circuit 10 outputs a color code of "0, 0, 0, 0" from its output terminal T1 or when the border signal BD outputted from the display processing circuit is "1", the output of the OR gate 20 is rendered "1" so that the color code contained in the BDC register 15 is outputted from the selector 16. In this case, if the color code is not "0, 0, 0, 0", the signal YS outputted from the zero-detection circuit 13 is rendered "0" so that the corresponding display element is displayed in a color designated by the color code contained in the BDC register 15. It is assumed here that color codes for displaying a video image shown in FIG. 3 are stored in the VRAM 5 wherein those of the color codes corresponding to the hatched display area D1 represent red and those of the color codes corresponding to the display area D2 are "0, 0, 0, 0". Also it is assumed that the color code contained in the BDC register 15 is representative of blue. In this case, the display elements in the display area D1 are displayed in red, while the display elements in the display area D2 and border area 4b are displayed in blue (backdrop color). Thus, each of the color codes of "0, 0, 0, 0" is processed as color code representative of transparency in this case, and the display elements corresponding to these color codes are displayed in the backdrop color.

The operation of this system in the case where the contents of the TP register 9 and the BDC register 15 are "0" and "0, 0, 0, 0" respectively will now be described. When a color code other than "0, 0, 0, 0" is outputted from the display processing circuit 10 with the border signal of "0", the color code outputted from the output terminal T1 of the display processing circuit 10 is supplied to the color palette circuit 17 through the selector 16 as described for the above case. On the other hand, when the border signal BD is "1" or when a color code of "0, 0, 0, 0" is outputted from the output terminal T1 of the display processing circuit 10, the output of the OR gate 20 is rendered "1" so that the color code of "0, 0, 0, 0" contained in the BDC register 15 is outputted from the selector 16. As a result, the output signal YS of the zero-detection circuit 13 is rendered "1" so that the CRT display unit 4 neglects the signals RV, GV, BV and SYNC and displays a video image (backdrop image) in accordance with the video signal CVD. Thus, in the case where color codes representative of the display image shown in FIG. 3 are stored in the VRAM 5 (those of the color codes corresponding to the display area D2 are "0, 0, 0, 0"), the display elements in the display area D1 are displayed in red and the backdrop image is displayed in the area D2 and border area 4b, whereby an L-shaped image of red color is superimposed on the backdrop image.

As described above, with the structure of this system one of the color codes can be used as either a color code representative of transparency or one representative of a specific color. Thus, this system can provide a video display image on the screen with more colors in comparison with the conventional systems.

The above system is designed so that a video image is displayed on the screen in a dot-map fashion, however it should be noted that the present invention can be applied to a video display control system in which a video image is displayed as a group of display patterns each composed of a predetermined number (for example 8×8) of display elements.

What is claimed is:

1. A video display control system adapted to be connected to a video display unit, for displaying a video image composed of a plurality of display elements on a screen of the video display unit and receiving a supplemental video signal, said apparatus comprising:

(a) memory means for storing a plurality of color codes and (b) display control means including:

(i) designating means for designating one of a plurality of display modes which include at least a first display mode which enables display of a specific kind of display attribute and a second display mode;

(ii) reading means for reading said color codes from said memory means;

(iii) first determination means for determining whether each color code read from said memory means coincides with a first predetermined color code;

(iv) storing and selecting means, responsive to said designating means and said first determination means, for storing at least one color code and selecting one of: (a) one of said stored at least one color codes and (b) said color code read from said memory means; and (v) means responsive to the output of said storing and selecting means and said designating means, for detecting transmission of a predetermined color code from storage in said storing and selecting means and for displaying said supplemental signal in response thereto.

2. A video display control system according to claim 1, wherein said mode designating means includes mode register means for storing first display mode data representing said first display mode.

3. A video display control system according to claim 1, wherein said display control means further comprises code register means for storing said certain color code.

4. A video display control system according to claim 3, wherein said certain color code stored in said register means is a color code representative of a backdrop color of the display image displayed on the screen.

5. A video display control system according to claim 3, wherein said display control means further comprises second determination means for determining whether said color code outputted from said selector means coincides with a second predetermined color code to output a second coincidence signal, and means for feeding an external video signal to the video display unit in response to said second coincidence signal when said designating means designates said first display mode.

6. A video display control system according to claim 1, wherein said conversion means includes a selector means for receiving said color code read from said memory means and said certain color code and for selectively outputting said certain color code in accordance with said first display mode.

7. A video display control system adapted to be connected to a video display unit for displaying a video image composed of a plurality of display elements on a screen of the video display unit comprising:

(a) memory means for storing a plurality of color codes each representing at least one of the display elements; and (b) display control means having (i) mode designating means for designating one of a plurality of display modes which include a transparency display mode, and at least one non-transparency display mode;

(ii) reading means for reading the color codes from said memory means;

(iii) determination means for determining whether each color code read from said memory means coincides with a predetermined color code;

(iv) storing and selecting means, responsive to said mode designating means and said determination means, for storing at least one color code, and for selecting, responsive to a display mode, one of: (a) one of said stored color codes, and (b) said color code read from said memory means; and (v) means, responsive to an output of said storing and selecting means, for detecting a predetermined color code therefrom, and for displaying a transparency signal in response thereto.

8. A video display control system according to claim 7, wherein said mode designating means comprises mode register means for storing first display mode data representing said first display mode.

9. A system as in claim 7 wherein said feeding means maintains said color code without converting when said determination means designates said second display mode.

10. A display control processor comprising:

memory means for storing a plurality of color codes representing display elements of a video screen, said memory means having a video output;

means for storing second video information indicative of a predetermined display attribute;

mode register means for storing a mode control signal representing a mode of operation of said processor, said mode being one of at least two modes including a first display mode which enables display of said predetermined display attribute, and a second display mode which does not enable said display attribute to be displayed;

code detecting means, coupled to said video output of said memory means, and to said mode register means, for producing an output signal indicative of said display attribute during said first mode when said memory means indicates a predetermined code; and selecting means, responsive to said output signal of said code detecting means and to said mode control signal, for: (1) selecting said video output from said memory means as an output during said second mode, (2) selecting said second video information from said second storing means when said mode control signal indicates said first mode and said output signal of said code detecting means is not produced and (3) selecting a video information indicative of said predetermined display attribute when said output signal of said code detecting means is produced.

11. A video display control system as in claim wherein said display attribute is transparency and said first display mode is a mode indicative of transparency, and said second display mode and modes other than said first and second display mode are non-transparency display modes, and wherein said another color code is a color code indicative of transparency.

12. A display control processor as in claim 10 wherein said display attribute is transparency and said first display mode is a transparency display mode and said second display mode is a non-transparency display mode.

* * * * *